US008915105B2

(12) United States Patent
Weinerman et al.

(10) Patent No.: US 8,915,105 B2
(45) Date of Patent: Dec. 23, 2014

(54) LATCH ASSEMBLY

(71) Applicant: The Eastern Company, Cleveland, OH (US)

(72) Inventors: Lee S. Weinerman, Medina, OH (US); Fredrick L. Putzier, Columbia Station, OH (US)

(73) Assignee: The Eastern Company, Cleveland, OH (US)

( * ) Notice: Subject to any disclaimer, the term of this patent is extended or adjusted under 35 U.S.C. 154(b) by 15 days.

(21) Appl. No.: 13/624,590

(22) Filed: Sep. 21, 2012

(65) Prior Publication Data

US 2014/0083147 A1 Mar. 27, 2014

(51) Int. Cl.
*E05B 13/10* (2006.01)

(52) U.S. Cl.
USPC 70/208; 292/207; 292/DIG. 30; 292/DIG. 31

(58) Field of Classification Search
USPC ..... 70/208, 209, 210, 211, 224; 292/208, 292/336.3, DIG. 30, DIG. 31
See application file for complete search history.

(56) References Cited

U.S. PATENT DOCUMENTS

| | | | | |
|---|---|---|---|---|
| 1,652,660 | A * | 12/1927 | Cevereaux | 70/210 |
| 5,913,908 | A * | 6/1999 | Czipri | 70/208 |
| 6,530,250 | B1 * | 3/2003 | Linares et al. | 70/208 |
| 6,532,778 | B2 * | 3/2003 | Molzer et al. | 70/208 |
| 6,666,053 | B2 * | 12/2003 | Sadler | 70/210 |
| 6,952,940 | B2 * | 10/2005 | Molzer et al. | 70/210 |
| 6,976,375 | B2 * | 12/2005 | Minix | 70/208 |
| 7,124,475 | B2 * | 10/2006 | Jeffries | 16/445 |
| 7,398,664 | B1 | 7/2008 | Weinerman et al. | |
| 7,454,933 | B1 | 11/2008 | Paige et al. | |
| 7,748,246 | B1 | 7/2010 | Paige et al. | |
| 2004/0007031 | A1 * | 1/2004 | Molzer et al. | 70/208 |
| 2006/0032277 | A1 * | 2/2006 | Molzer et al. | 70/210 |

* cited by examiner

*Primary Examiner* — Christopher Boswell
(74) *Attorney, Agent, or Firm* — Christopher L. Parmelee; Walker & Jocke

(57) ABSTRACT

A compression latch is provided having a lock bolt operated via a codable cylinder lock. The lock bolt includes a guide having first and second inner surfaces. The lock includes a rotatable portion having a cam with a projection that is movable between the first and second inner surfaces. When the rotatable portion of the cylinder lock rotates via the key to cause the projection to move from a first position to a second position, the projection contacts the second inner surface and urges the lock bolt to engage a control member which prevents a handle of the compression latch from rotating. When the rotatable portion rotates via the key to cause the projection to move from the second position to the first position, the projection contacts the first inner surface and urges the lock bolt to disengage from the control member, which enables the handle to rotate.

19 Claims, 12 Drawing Sheets

LATCH ASSEMBLY

BACKGROUND

Latch assemblies are mechanical apparatuses that are typically used to releasably hold two elements in closed relation. Such elements for example may include a closure member and a body member. For example, latch assemblies may be used to releasably hold a closure member such as a door or hatch in a closed position relative to a body member such as a door frame or hatch frame. Latch assemblies may benefit from improvements.

SUMMARY

The following is a brief summary of subject matter that is described in greater detail herein. This summary is not intended to be limiting as to the scope of the claims.

In example embodiments of one or more inventions described herein, a latch assembly may include an improved lock mechanism. Such a lock mechanism for example may be operated by a key that is inserted into a key receptacle of the lock mechanism. Rotating the key in one direction (e.g. clockwise) may lock the lock mechanism in a configuration which prevents the latch assembly from operating to permit opening of a closure member (e.g., a door, hatch). Also, rotating the key in an opposite direction (e.g., counter-clockwise) may unlock the lock mechanism, such that the lock mechanism is in a configuration which permits the latch assembly to operate and allow opening of the closure member.

Examples of latch assemblies that may include embodiments of the lock mechanisms described herein include compression latches. Compression latches typically include a handle that is lifted (to release compression forces) and that is turned. Turning the handle typically operates the latch: to move a pawl relative to a frame; to move linkages; and/or to carry out other latching operations. Different types of compression latches may include different styles and configuration of handles such as a generally "T" shaped handle and a generally "D" shaped handle. An example of a "T" shaped handle compression latch is shown in U.S. Pat. No. 7,454,933 issued Nov. 25, 2008, which is hereby incorporated by reference herein in its entirety.

Such compression latch assemblies may include a housing having a front side and a rear side. Such latch assemblies may also include a shaft extending through the housing along an axis from the front side to the rear side of the housing. In addition, such latch assemblies may have the handle in operative connection with the shaft on the front side of the housing.

Further, such latch assemblies may include a control member in operative connection with the shaft on the rear side of the housing. The control member may include different features connected thereto for engaging a closure member to a body member such as a latch roller and/or one or more linkages. In addition, the control member may include a one or more notches (or other features) that are releasably engaged by a lock mechanism to prevent rotation of the control member.

In an example embodiment, the shaft is operative to move relative to the housing rotationally responsive at least in part to movement of the handle. This enables the shaft, handle, and control member to rotate between a first rotational position and a second rotational position.

In addition, the shaft is operative to move relative to the housing axially (which provides and releases compression between elements of the control member that engage with a body member). To control such compression, the latch assembly may include one or more springs that are operative to bias the control mechanism rearward away from the housing. To counteract the bias of the spring and move the shaft and control mechanism towards the housing, the handle may be operative to pivot relative to the shaft. As the handle pivots from a lifted/extended position (extending out of the housing) to a lowered/retracted position (extending generally along and/or in a cavity of the housing), cam surfaces on the handle are operative to slide adjacent engagement portions on the front side of the housing and cause the shaft and control member to be pull forwardly (which moves the control member towards the housing). Conversely, when the handle is pivoted from the lowered/retracted position to the lifted/extended position, the cam surfaces on the handle are operative to slide adjacent engagement portions on the front side of the housing and permit the spring to urge the shaft and control member to move rearwardly (which moves the control member farther away from the housing).

In this example, the latch assembly further includes a lock mechanism having a lock such as a cylinder lock that extends through an aperture in the housing. The lock cylinder includes a lock body and a rotatable portion. The rotatable portion is operative to move rotationally with respect to the lock body between a first rotational position and a second rotational position responsive to rotation of a key inserted into a receptacle of the cylinder lock.

The lock mechanism also includes a cam in operative connection with the rotational portion of the cylinder lock. The cam includes an arm that extends radially from a rotational axis, about which the rotational portion rotates. The cam also includes a projection in operative connection with a portion of the arm that is spaced apart radially from the lock body. The projection extends from the arm in a direction parallel to the rotational axis of the rotational portion. In this example, when the rotational portion moves between the first rotational position and the second rotational position, the projection moves between a first position and a second position. The arm may be positioned on the rotational portion such that the second position of the projection is closer to the shaft of the latch assembly than the first position of the projection.

In this example, the lock mechanism also includes a lock bolt. The lock bolt includes a bolt end and a guide. The guide includes first and second spaced apart inner surfaces, where the second inner surface is closer to the shaft than the first inner surface. In this example embodiment, when the projection moves from the second position to the first position (responsive to rotation of the rotational portion), the projection is operative to contact the first inner surface of the guide and urge the lock bolt to move such that the bolt end moves away from the shaft. In addition, when the projection moves from the first position to the second position and the control member is in the first rotational position, the projection is operative to contact the second inner surface and urge the lock bolt to move such that the bolt end moves towards the shaft and into the first notch of the control member.

Engagement of the bolt end in the first notch of the control member is operative to prevent the control member (and shaft and handle) from rotating. In this example the lock cylinder is lockable by use of the key while the bolt end is engaged with the first notch. Consequently, without using the key to unlock the lock cylinder, the bolt end will remain in the notch of the control member and prevent the control member (and shaft and handle) from rotating. In order to permit the control member (and shaft and handle) to rotate, the key may be inserted into the lock cylinder and rotated to cause the rotatable portion to rotate and consequently cause the bolt end to move out of the notch of the control member.

In this described example, the guide may include two apertures therethrough. The first aperture may include the first and second inner surfaces and the projection may extend in the first aperture. Also in this example, the rotatable portion of the lock may extend in the second aperture. When the rotatable portion rotates, the arm of the cam is operative to move generally parallel to the guide to cause the projection to move within the first projection.

In an example embodiment of the lock mechanism, the lock body and rotational portion may correspond to a codable cylinder. Such a codable cylinder may include a coding function in which the lock is capable of being coded for a key responsive to the key being inserted into the lock and rotated. In some embodiments, the codable cylinder may be operative to prevent the coding function from being carried out more than once.

Other aspects will be appreciated upon reading and understanding the attached figures and description.

DETAILED DESCRIPTION

Figure 1:
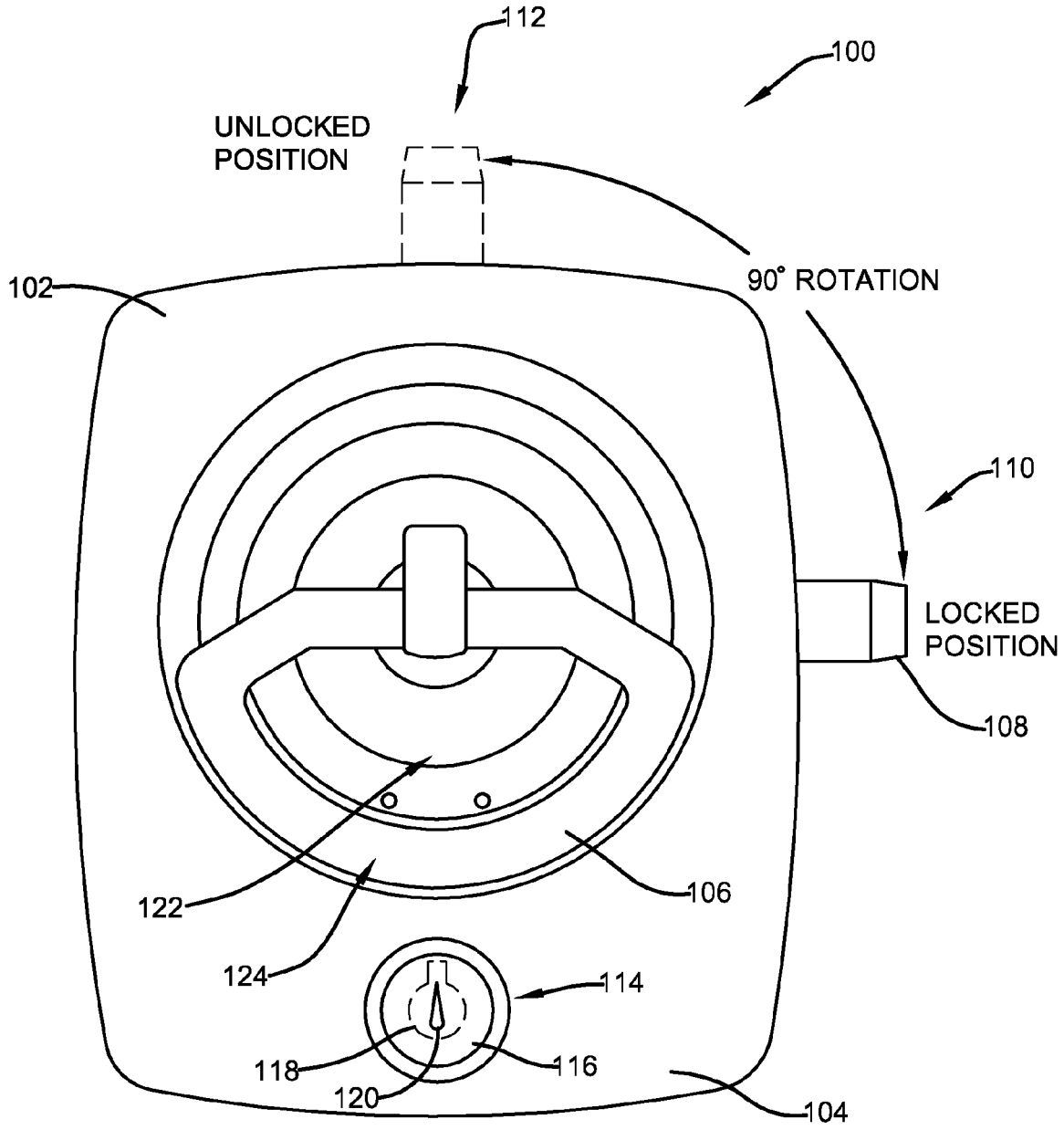
FIG. 1 is a front view of an example latch assembly.

Various technologies pertaining to a lock mechanism for a latch assembly will now be described with reference to the drawings, where like reference numerals represent like elements throughout. Also, it is to be understood that functionality that is described as being carried out by certain components may be performed by multiple components. Similarly, for instance, a component may be configured to perform functionality that is described as being carried out by multiple components.

With reference to FIG. 1, an example latch assembly 100 is illustrated. In this example the latch assembly corresponds to a D-ring compression latch 102. However, it should be noted the features described herein for the latch assembly 100 may be used on other types of latch assemblies including those compression latches with a generally "T" shaped handle and other types and styles of compression latches with lift and turn handles.

The latch assembly 100 includes a housing 104 which services as a receptacle for a pivotable and rotatable handle 106. Rotation of the handle 106 is operative to move one or more latching elements mounted on the rear side of the housing. Such a latching element for example may include a roller 108. When the handle and roller are in the orientation shown in FIG. 1, the roller 108 may be in a position 110 that is operative to extend behind a striker/bracket or other feature of a body member (e.g. a door frame/hatch frame) in order to prevent opening of the closure member. When the handle 106 is rotated (e.g., such as counter clockwise 90 degrees or other direction and amount of rotation), the roller 108 is operative to move to a position 112 (or other position) which causes the closure member to become unlatched and enables the closure member to be opened.

In this example the handle 106 includes an aperture 122 therethrough in which a user may insert fingers in order to grasp an outer portion 124 of the handle 106 and for purposes of pivoting and rotating the handle. As shown in a side view 200 of FIG. 2, pulling on the outer portion 124 of the handle 106 is operative to cause the handle to pivot from a lowered/retracted position 202 to a raised/extended position 204. Also, the handle is operative to pivot with respect to a shaft 206 (e.g., via a pin 208 that extends through the base of the handle 106 and the end of the shaft 206). The shaft 206 extends through an aperture in the housing between a front side 210 and a rear side 214 of the housing 104. A control member 212 is in operative connection with the shaft 206 on the rear side 212 of the housing.

Figure 2:
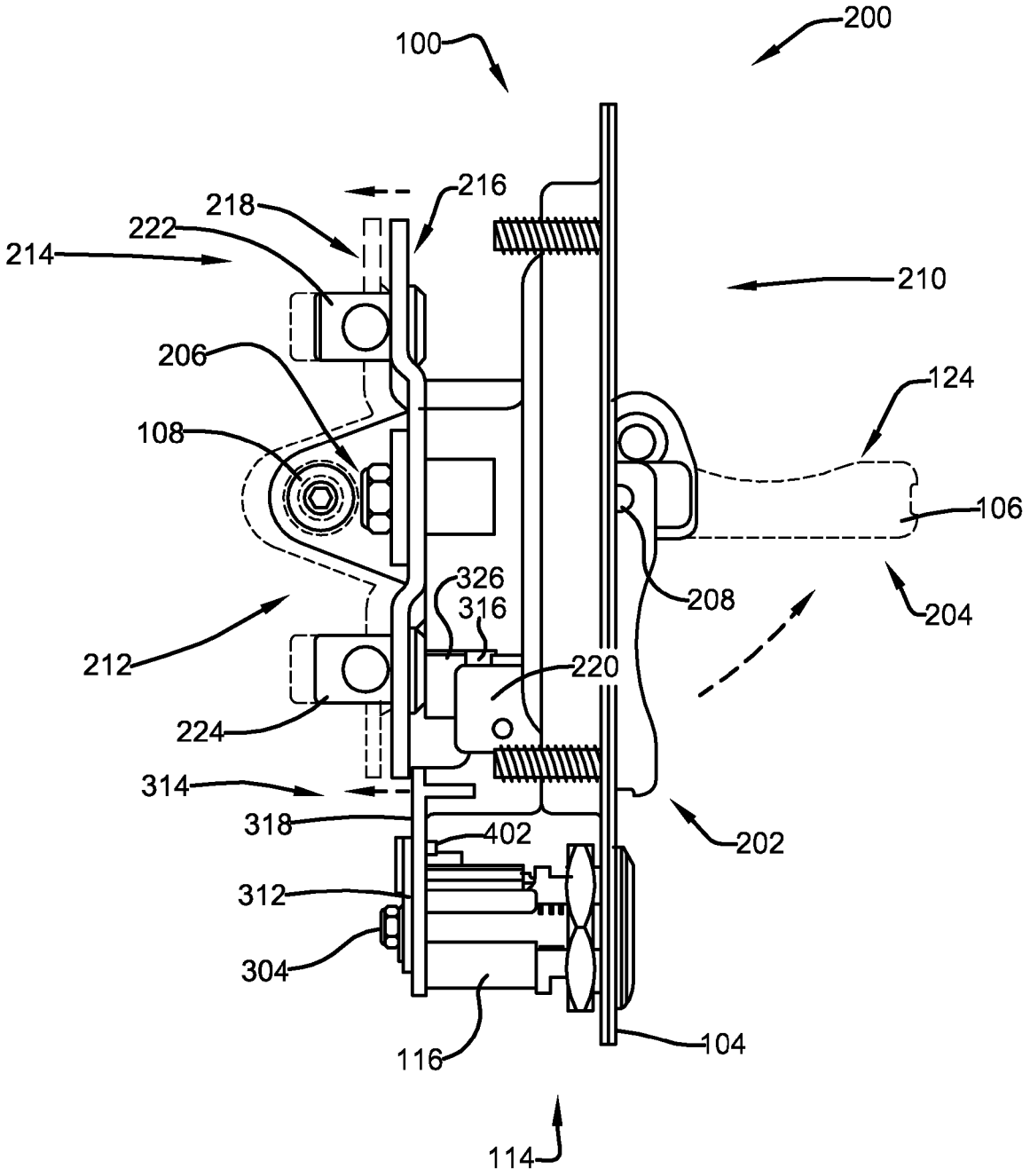
FIG. 2 is a side view of the latch assembly.

As schematically illustrated in FIG. 2, when the handle pivots from the retracted position 202 to the extended position 204, the control member 212 moves from a forward position 216 to a rearward position 218. Also, when the handle pivots back to the retracted position 202, the control member 212 moves back to the forward position 218. The control member may include one or more latch elements (such as the roller 108) that use the movement of the control member 212 to the forward position 216 to provide compression forces usable to hold a closure member such as a door or a hatch more tightly against an adjacent body member such as a door/hatch frame. Such a roller 108 may be pressed (via retraction of the handle 106) against a striker/bracket and as a result can pull the door (to which the latch assembly 100 is mounted) tightly against a door frame. Conversely movement of the control member 212 to the rearward position 218, withdrawals the compression forces usable to hold a door (or other closure member) tightly against an adjacent door frame (or other body member). Also the withdrawal of the compression forces permits the handle 106, shaft 206, and control member 212 to be rotated more freely (via rotation of the handle).

In an example embodiment, to cause the movement of the control member 212 between the forward/rearward positions, the handle 106 may include a cam surface (not shown) that is operative to slide relative an engagement surface on the front side 210 of the housing 104. When moving the handle from the retracted position 202 to the extended position 204, the cam surface is operative to move to an orientation, that permits the shaft 206 and control member 212 to be urged (via a spring) rearwardly. Conversely, when moving the handle back to the retracted position 202, the cam surface is operative to move to an orientation, that pulls the shaft 206 and control member 214 forwardly.

As illustrated in FIG. 1, an example embodiment of the latch assembly 100 may include a lock mechanism 114 including a key operated cylinder lock 116. Inserting a key into the cylinder lock 116, and turning the key is operative to cause further portions of the locking mechanism 114 on the rear side of the housing to engage with and prevent the control member (as well as the shaft and handle) from rotating. Conversely, inserting the key into the lock cylinder lock 116, and turning the key in an opposite direction is operative to cause the further portions of the locking mechanism on the rear side of the housing to disengage with and enable the control member (as well as the shaft and handle) to rotate.

Figure 3:
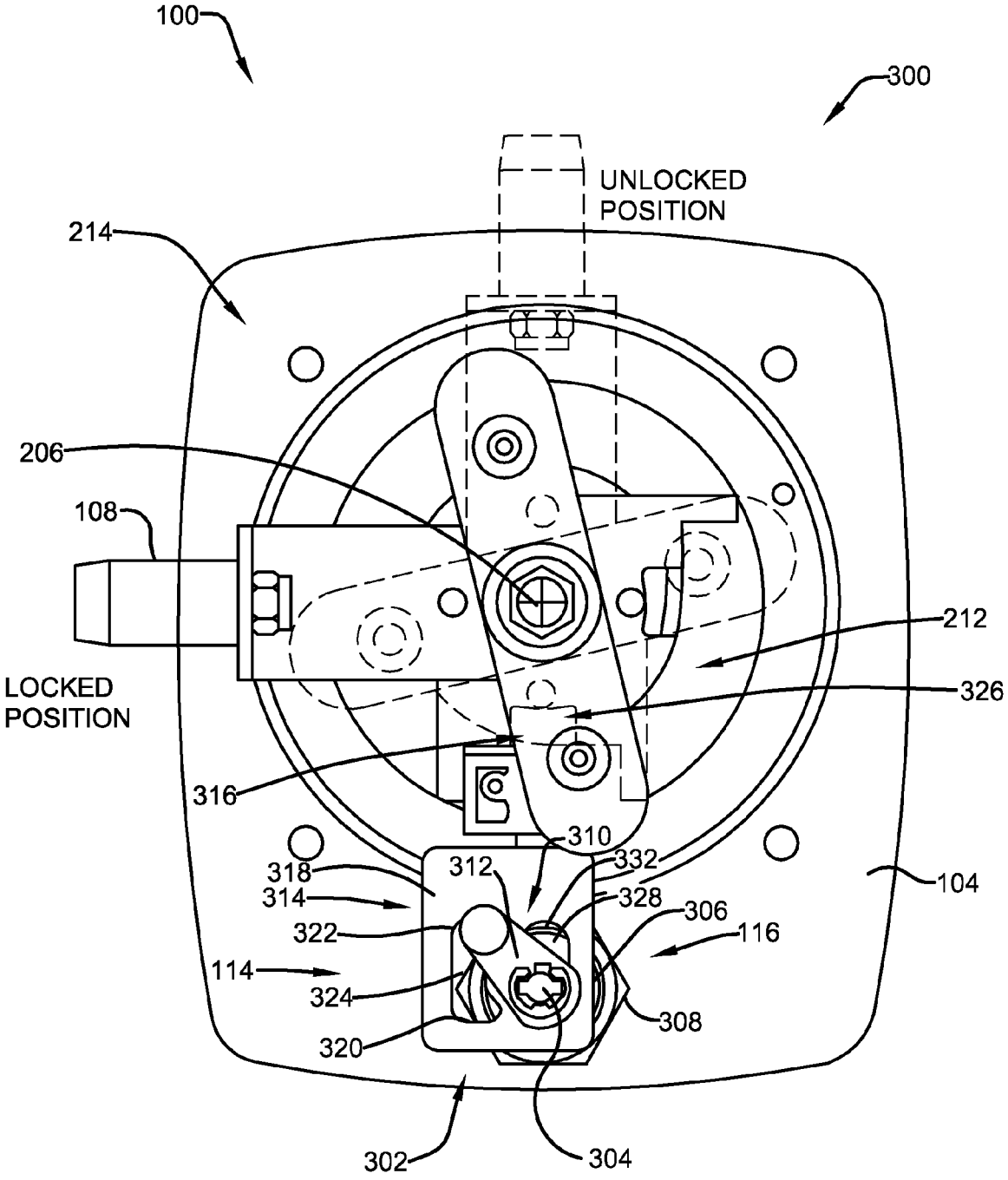
FIG. 3 is a rear view of the latch assembly.

FIG. 3 illustrates an example 300 of the rear side 212 of the latch assembly 100, showing further portions 302 of the locking mechanism. As shown in FIG. 3, the cylinder lock 116 includes a rotational portion 304. The rotation portion 304 rotates relative to a lock body/housing 306 of the cylinder lock 116 responsive to the rotation of the key. Such a body/housing 306 of the cylinder lock may be mounted to the housing 104 via a fastener such as a barrel nut 308.

Figure 4:
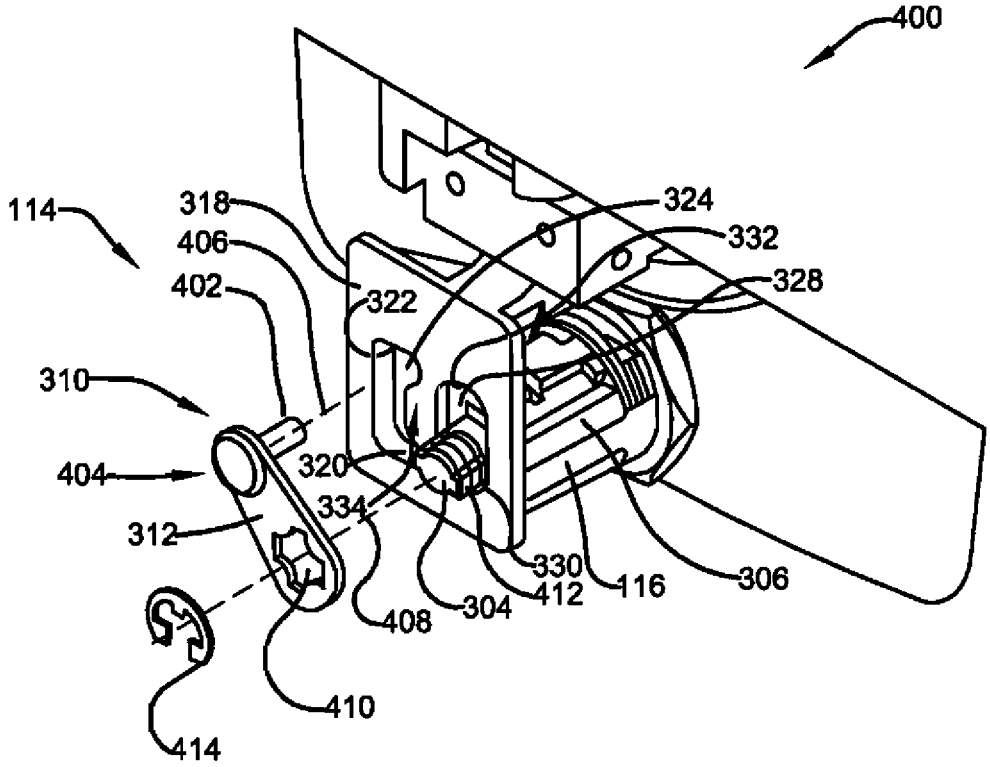
FIG. 4. is an exploded view of a portion of a lock mechanism.

In this example, the locking mechanism further includes a cam 310 in operative connection with the rotational portion 304 of the cylinder lock 116. This cam includes an arm 312 that extends radially from the rotational portion 304. To show features of the cam more clearly, FIG. 4 shows an isometric exploded view 400 of the cam 310 and cylinder lock 116. In this example embodiment, the cam 310 further includes a projection 402 in operative connection with an end portion 404 of the arm that is spaced apart radially from the lock body 306. The projection 402 includes a central axis 406 that extends from the arm 312 in a direction that is substantially parallel to a rotational axis 408 of the rotational portion 304 of the cylinder lock 116.

As shown in FIG. 4, the arm 312 may include an aperture 410 through which an end 412 of the rotatable portion 304 may extend. The cam arm 312 may then be secured to the end 412 of the rotatable portion 304 via a fastener 414 (e.g. e-ring). Both the contour of the aperture 410 and the contour of the end 412 of the rotatable portion may have cooperating features so as to mechanically couple the elements together and enable the arm 312 to rotate between different rotational positions responsive to rotation of the rotatable portion 306 of the cylinder lock 116.

For example, the arm 312 may be mounted to the end 412 in a radial orientation, such that when the rotatable portion 304 (and arm 312) rotates between a first rotational position and a second rotational position (caused by rotation of a key in a first direction), the projection 402 of the cam 310 moves from a first (i.e., lower) position (that is relatively farther from the shaft 206 of the latch assembly) to a second (i.e., upper) position (that is relatively closer to the shaft 206 than the first position).

Figure 5:
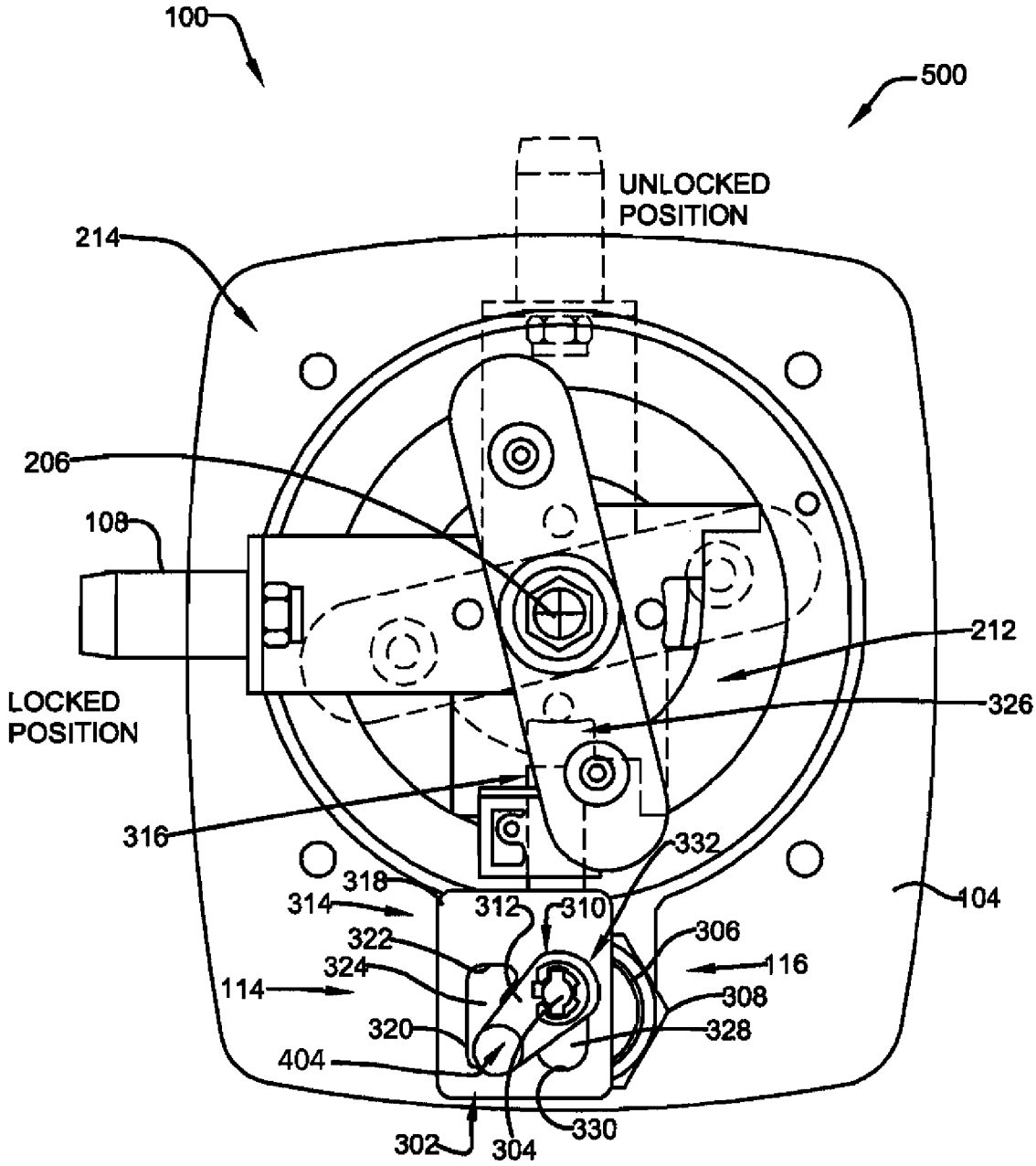
FIG. 5 is a rear view of the latch assembly.

FIGS. 2-4 illustrate the arm 312 of the cam 310 in the second rotational position and the projection 402 in the second (i.e., upper) position. FIG. 5 shows an example 500 that illustrates the arm 312 in the first rotation position and the projection 402 in the first (i.e., lower) position. It should be appreciated that the projection 402 is operative to move from the second position back to the first position responsive to rotation of the rotatable portion 304 (and arm) from the second rotational position back to the first rotational position (caused by rotation of a key in an opposite second direction).

As show in FIGS. 3, 4, and 5, the lock mechanism 114 further includes a lock bolt 314. In this example, movement of the cam 312 is operative to cause the lock bolt 314 to move between positions which engage with and disengage from the control member 212. To accomplish this, the lock bolt 314 includes a bolt end 316 and a guide 318. As illustrated in FIGS. 3, 4, and 5, the guide 318 includes first and second spaced apart inner surfaces 320, 322 between which the projection 402 extends and is operative to contact. In this example, the first and second inner surfaces correspond to opposed ends of a first aperture 324 through the guide 318 in which the projection 402 extends therein. However, it should be appreciated that in alternative embodiments, the first and second surfaces 320, 322 may be located on opposed sides of a channel on a side of the guide, on spaced apart brackets extending from a side of the guide, or on other elements of the guide that are spaced apart.

In an example embodiment, the guide 318 of the lock bolt 314 is orientated such that the second inner surface 322 is closer to the shaft 206 than the first inner surface 320. Thus, when the projection 402 (shown in FIG. 4) moves from the second position (shown in FIG. 3) to the first position (shown in FIG. 5), the projection 402 is operative to contact the first inner surface 320 and urge the lock bolt 314 to move such that the bolt end 316 moves away from the shaft 206 and out of engagement with the control member 212. Conversely, when the projection (shown in FIG. 4) moves from the first position (shown in FIG. 5) to the second position (shown in FIG. 3) (and the control member is in the first rotational position shown in FIG. 3), the projection 402 is operative to contact the second inner surface 322 and urge the lock bolt 314 to move such that the bolt end 316 moves towards the shaft 206 and into engagement with the control member 212.

In this described example, the control member includes an engagement portion 326 such as a notch or opening that is operative to receive the bolt end 316 therein, and thereby prevent the control member 212 (and shaft 206, and handle 106) from rotating. Such a notch 326 may have a sufficient depth, such that the control member and shaft may move between the rearward/forward positions 216, 218 (shown in FIG. 2) and still enable the bolt end 316 to remain in the notch 326.

As shown in FIG. 4, the guide 318 may further include a second aperture 328, through which the end 412 of the rotatable portion 304 of the cylinder lock 116 extends therein. As shown in FIG. 3, the second aperture 328 is elongated in a direction of a vector that extends from the shaft 206 of the latch assembly and through the cylinder lock 116. The second aperture 328 includes a first inner end 330 and a second inner end 322. The second inner 332 end is closer to the shaft 206 than the first inner end 330. In this example, when the projection 402 (shown in FIG. 4) moves from the second position (shown in FIG. 3) to the first position (shown in FIG. 5), the first inner end 330 moves closer to the rotatable portion 304 of the cylinder lock 116 and the second inner end 332 moves farther from the rotational portion 304. Conversely, when the projection 402 (shown in FIG. 4) moves from the first position (shown in FIG. 5) to the second position (shown in FIG. 3), the first inner second end 332 moves closer to the rotatable portion 304 of the cylinder lock 116 and the first inner end 330 moves farther from the rotational portion 304.

In this example, the elongated second aperture 328 enables the guide 318 and the entire lock bolt 314 to move linearly (e.g., up and down) rather that rotationally responsive to the movement of the projection 402 of the cam 310. To further limit the lock bolt 314 from moving rotationally, the described latch assembly may include rails on either side of the lock bolt to prevent lateral movement of the lock bolt as it moves towards and away from the control member 212. FIG. 2 shows a rails 220 adjacent one side of the previously described bolt end 316.

Referring back to FIG. 4, in an example embodiment, the first aperture 324 of the guide 318 may include an inner projection 334 that extends between at least a portion of the first and second inner surfaces 320, 322. Such an inner projection may include radiused (e.g., curved) surfaces, which facilitate guiding the projection 402 of the cam as it travels within the first aperture 324.

In an example embodiment, the cylinder lock 116 corresponds to codable cylinder. Such a codable cylinder includes a coding function in which the lock is capable of being coded for a key responsive to the key being inserted into the lock and rotated. Such a codable cylinder is operative to prevent the coding function from being carried out more than once. As shown in FIG. 1, to prevent the lock from being accidently coded, the described codable cylinder may include an adhesive tab 118 over top of the key hole 120 of the cylinder lock 116. Such a tab may be peeled away prior to inserting a key and turning the rotatable portion of the cylinder lock (in order to code the cylinder lock to the inserted key).

Also, it should be understood that the profile (i.e., sizes and contours) of the cam 310 and aperture 410 in the cam (and other components described herein) may be adapted for use with different types of key operated locks, including conventional key locks that are not codeable via turning a key in the lock. Further, the profile of the cam 310 and aperture 410 of the cam may have other shapes to accommodate alternative configures for the rotatable portion of the cylinder locks. For example, FIGS. 11 and 12 show isometric exploded views 1100 and 1200 of alternative cams 1102, and 1202 adapted to mount to alternative configurations of the rotatable portions 1104, 1204 of lock(s) 116.

Figure 11:
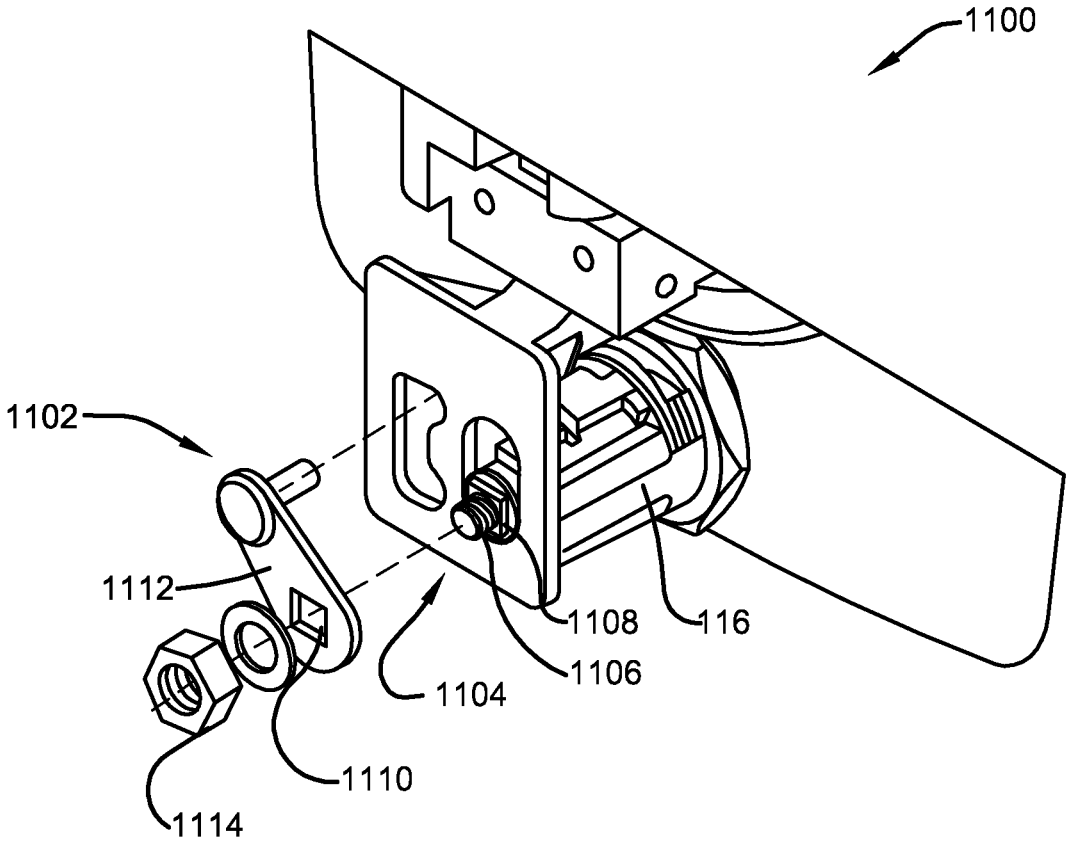
FIGS. 11 and 12 are exploded views of alternative examples of portions of a lock mechanism.
Figure 12:
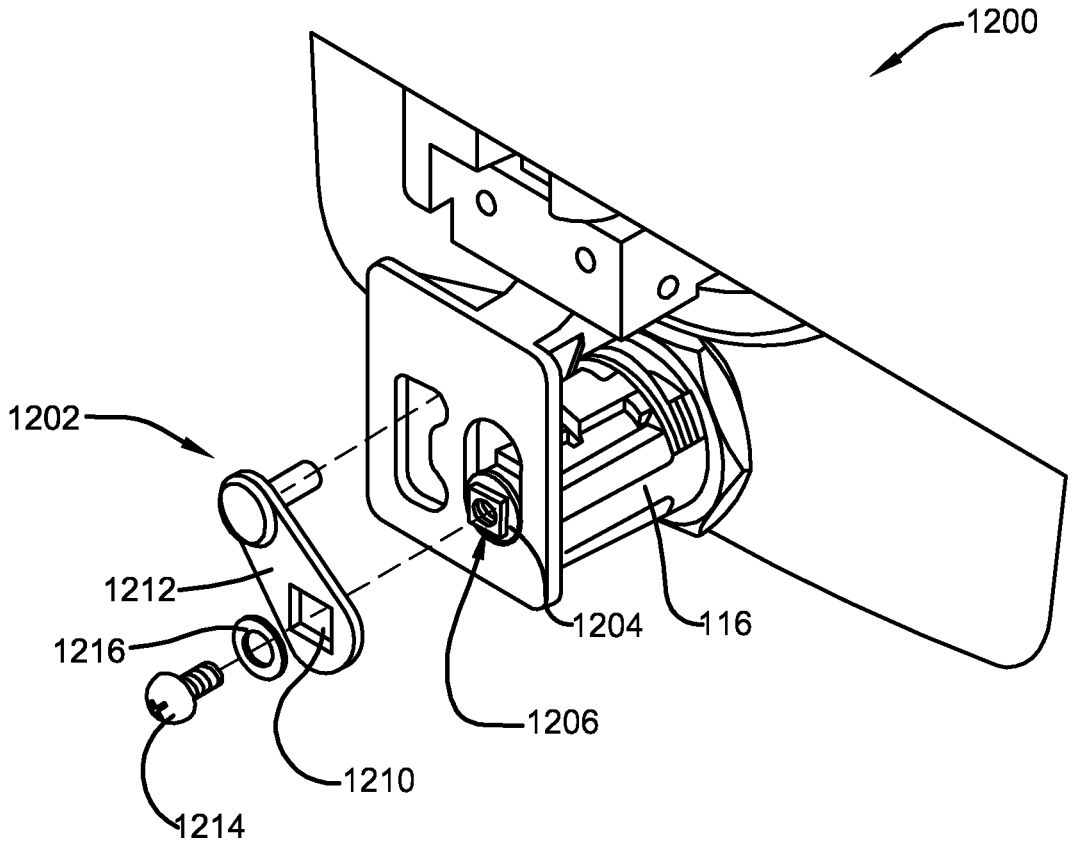

The example in FIG. 11 illustrates a rotatable portion 1104 of a cylinder lock 116 that includes a threaded projection 1106 extending from a square shoulder 1108. In this example the aperture 1110 of the cam arm 1112 has a square contour adapted to engage with the square shoulder 1108. A threaded fastener such as a nut 1114 may then be mounted on the male threaded projection 1106 to secure the cam 1102 to the rotatable portion 1104 of the lock 116. In a further example, FIG. 12 illustrates a rotatable portion 1204 that includes a square raised shoulder with a female internally threaded bore 1206 therein. A threaded fastener such as domed, male screw 1214 and washer 1216 (e.g., SEMS style) may then be mounted to the threaded bore 1206 to secure the cam 1202 to the rotatable portion 1204 of the lock 116. It should also be understood that the embodiments described herein are not limited to these examples, but may include any configuration of cam apertures, ends of the rotatable portions, and fasteners that are capable of mounting the described cams to the rotatable portion of a cylinder lock.

As shown in FIGS. 2, 3, and 5, the described control member 212 may include the features such as the roller 108 that rotate with the control member 212 in order to latch a door to a door frame (or carry out another latching function). In addition (or alternatively) to such a roller, as shown in FIG. 2, the control member may include one or more rod adapters 222, 224 that are operative to receive rods or other linkages therein, which are secured via a threaded pin, or other fastener. Such rods or linkages may be connected to other components that are operative to latch a door to a door frame (or carry out other latching functions).

Figure 6:
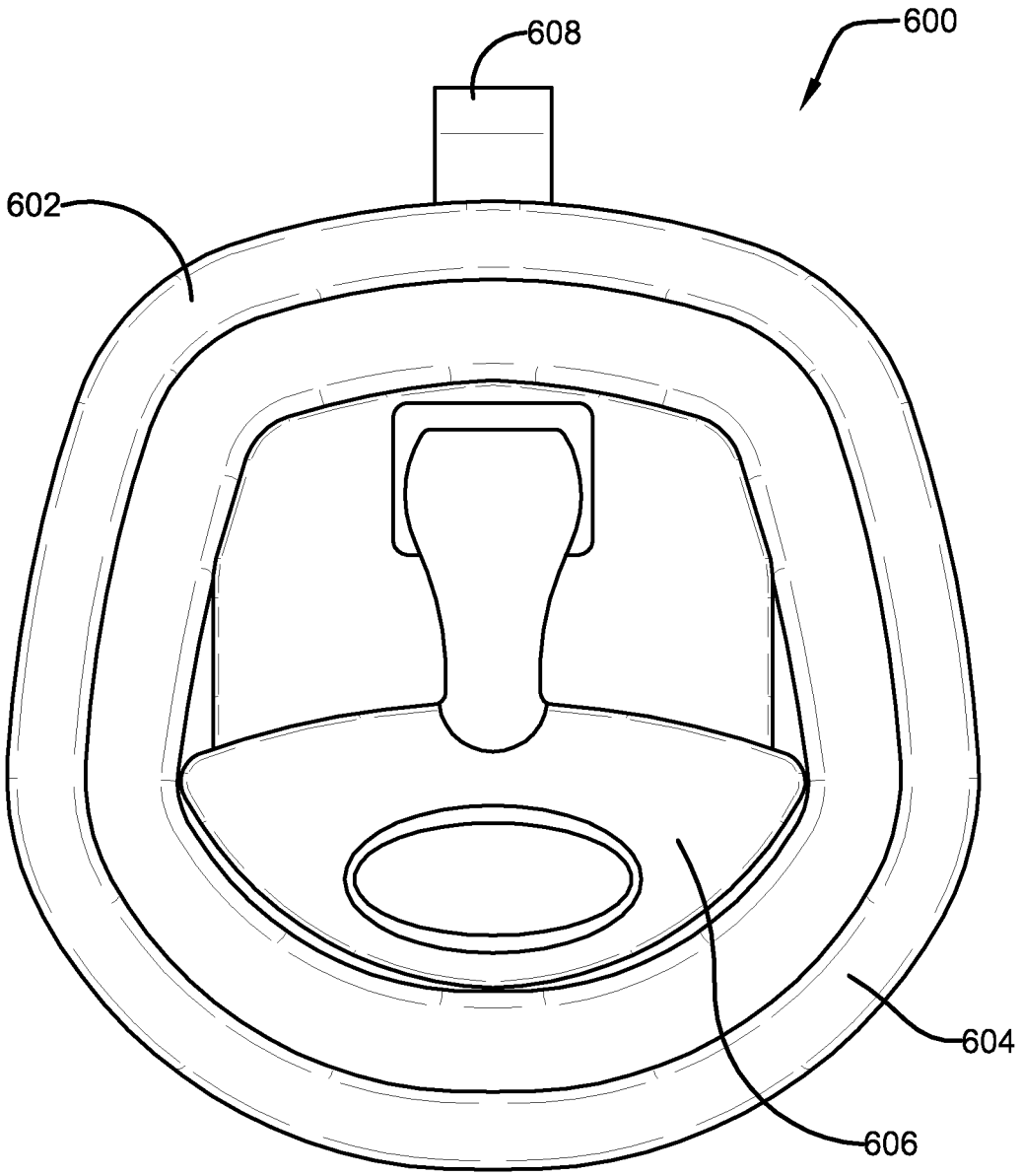
FIG. 6 is a front view of an alternative example latch assembly.
Figure 7:
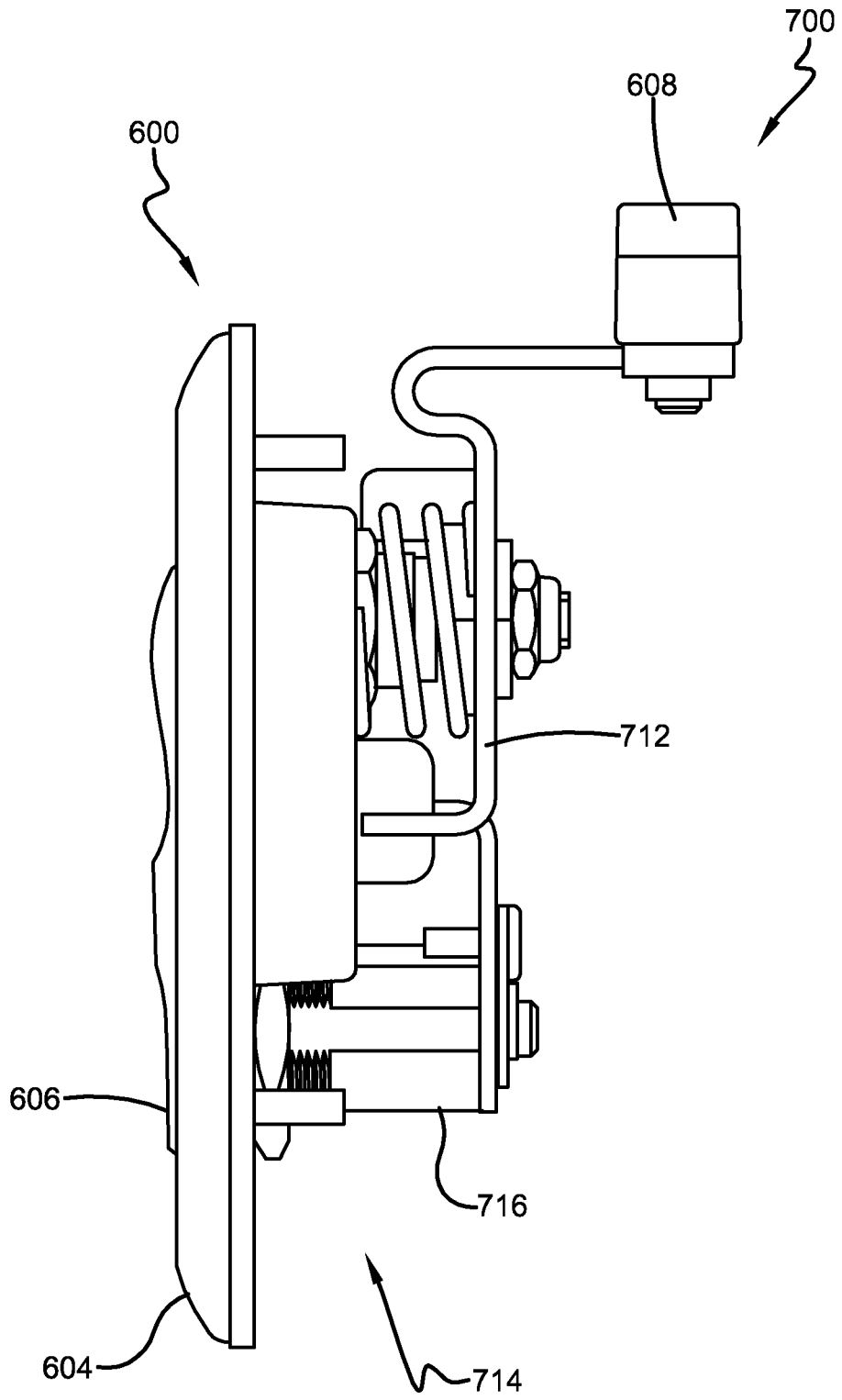
FIG. 7 is a side view of the alternative latch assembly.

It should be understood that features of the previously described latch assembly applied in the form of a D-ring compression latch may be included in other types of latch assemblies. FIG. 6 shows an alternative example latch assembly 600 with several of the previously described features integrated into a T-shaped handle compression latch 602. As shows in FIG. 6, the latch assembly 600 includes a housing 604 and a handle 606. Such a handle 606 is in pivoting and rotating connection with the housing. Thus, to disengage the latch, the handle may be pivoted into an extended position and rotated. The pivoting of the handle 606 to an extended position moves a roller 608 rearwardly, whereas the rotation of the handle 606 rotates the roller 608 with respect to the housing 604. FIG. 7 shows a side view 700 of the latch assembly 600. As illustrated in FIG. 7, the latch assembly may include a lock mechanism 714 including a cylinder lock 716. It should be appreciated that in this example, the handle 604 is operative to cover a keyhole of the cylinder lock when the handle is in a retracted position, such as shown in FIG. 6. Thus to insert a key into the cylinder lock 716, the handle is lifted to an extended position. Also, as shown in FIG. 7, the latch assembly 600 includes a control member 712 which moves forwardly/rearwardly and rotates responsive to the handle 606. Such a control member includes the roller 608 in operative connection therewith and may include other or additional latching features such as rod adapters usable to mount rods and/or other types of linkages of which the latch assembly may move.

Figure 8:
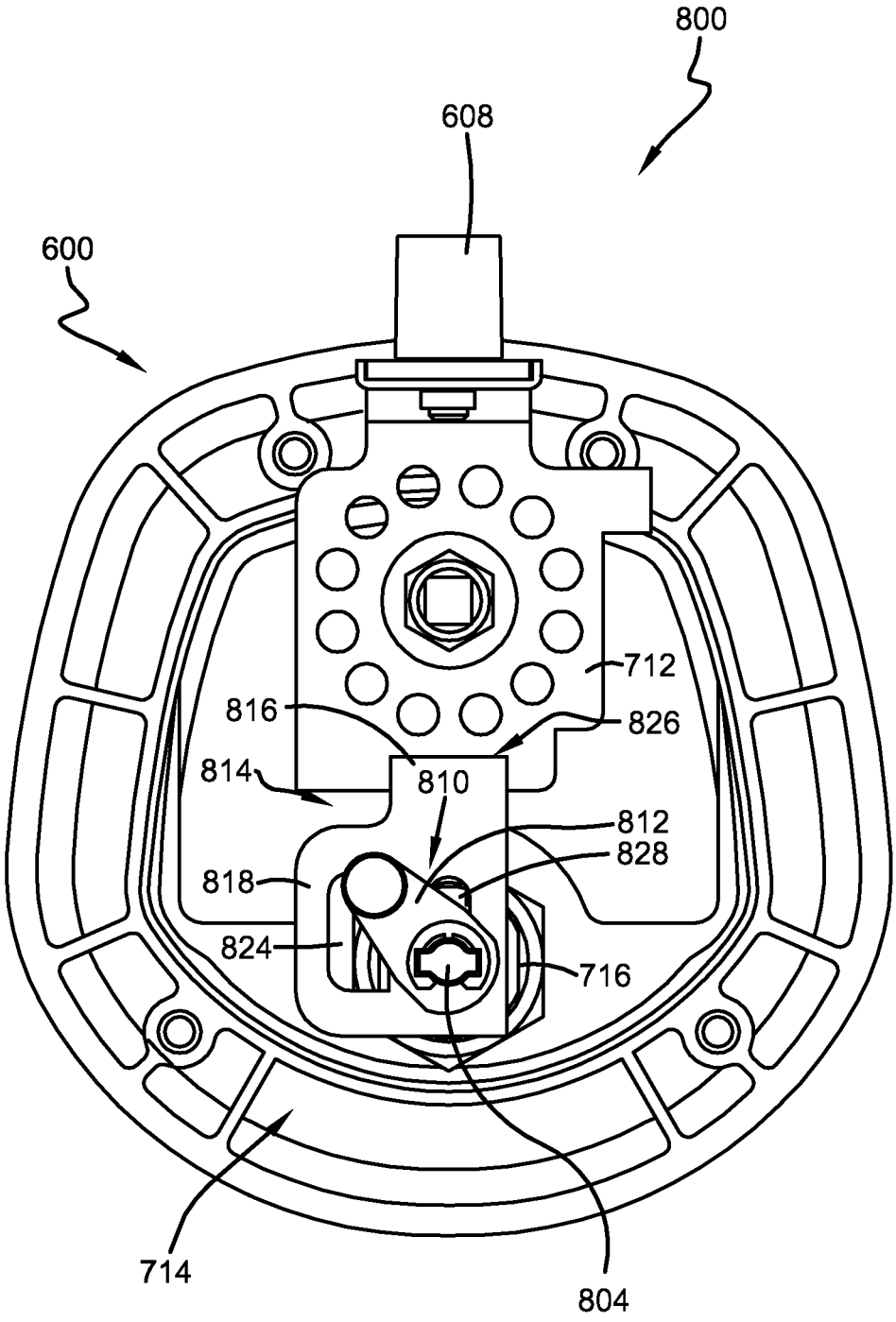
FIG. 8. is a rear view of the alternative latch assembly.

FIG. 8, shows a rearward view 800 of the latch assembly 600. In this example, the control member may include a plurality of holes arranged in a circular pattern (or other pattern) to accommodate the mounting of one or more other types of linkages to the latch assembly. As with the previously described embodiment, the latch assembly 600 may also include a cam 810 in operative connection with the rotational portion 804 of the cylinder lock 716. This cam includes an arm 812 that extends radially from the rotational portion 804.

This described embodiment of a latch assembly also includes a lock bolt 814.

In this example, movement of the cam 812 is operative to cause the lock bolt 814 to move between positions which engage with and disengaged from the control member 712. As in the prior embodiment (shown in 3-5), the lock bolt 814 includes a bolt end 816 and a guide 818 with two apertures 824, 828 therethrough. When the cam 810 rotates into the position shown in FIG. 8 (as a result of the cylinder lock being placed in a locked configuration via a key), the cam 810 is operative to urge the guide 818 such that the bolt end 816 extends into a notch 826 in the control member 712 (which prevents rotation of the control member and handle).

Figure 9:
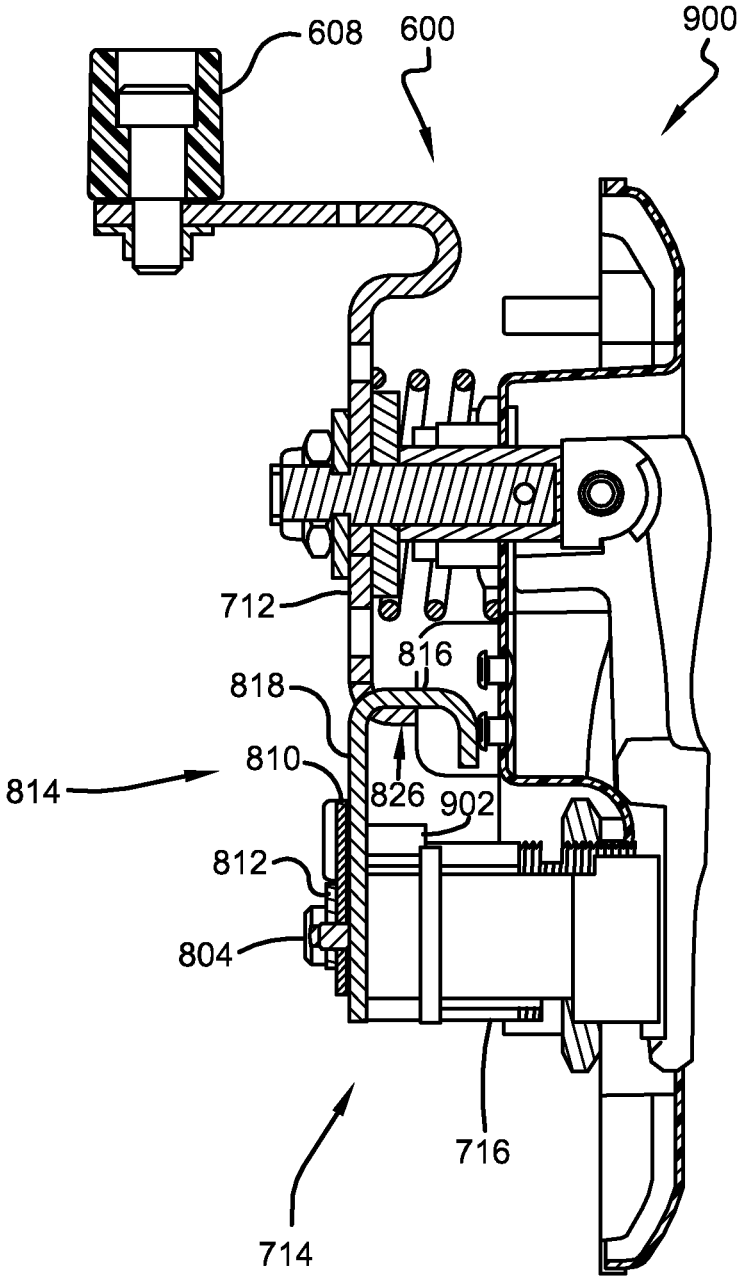
FIG. 9 is a cross-sectional view of the alternative latch assembly.

To show features of the cam more clearly, FIG. 9 shows a cross-sectional view 900 of the latch assembly 600. As in the previously described embodiment, the cam 810 includes a projection 902 which extends in the aperture 824 in the guide 810 and is operative to urge the guide 810 to move towards and away from the control member 712.

Figure 10:
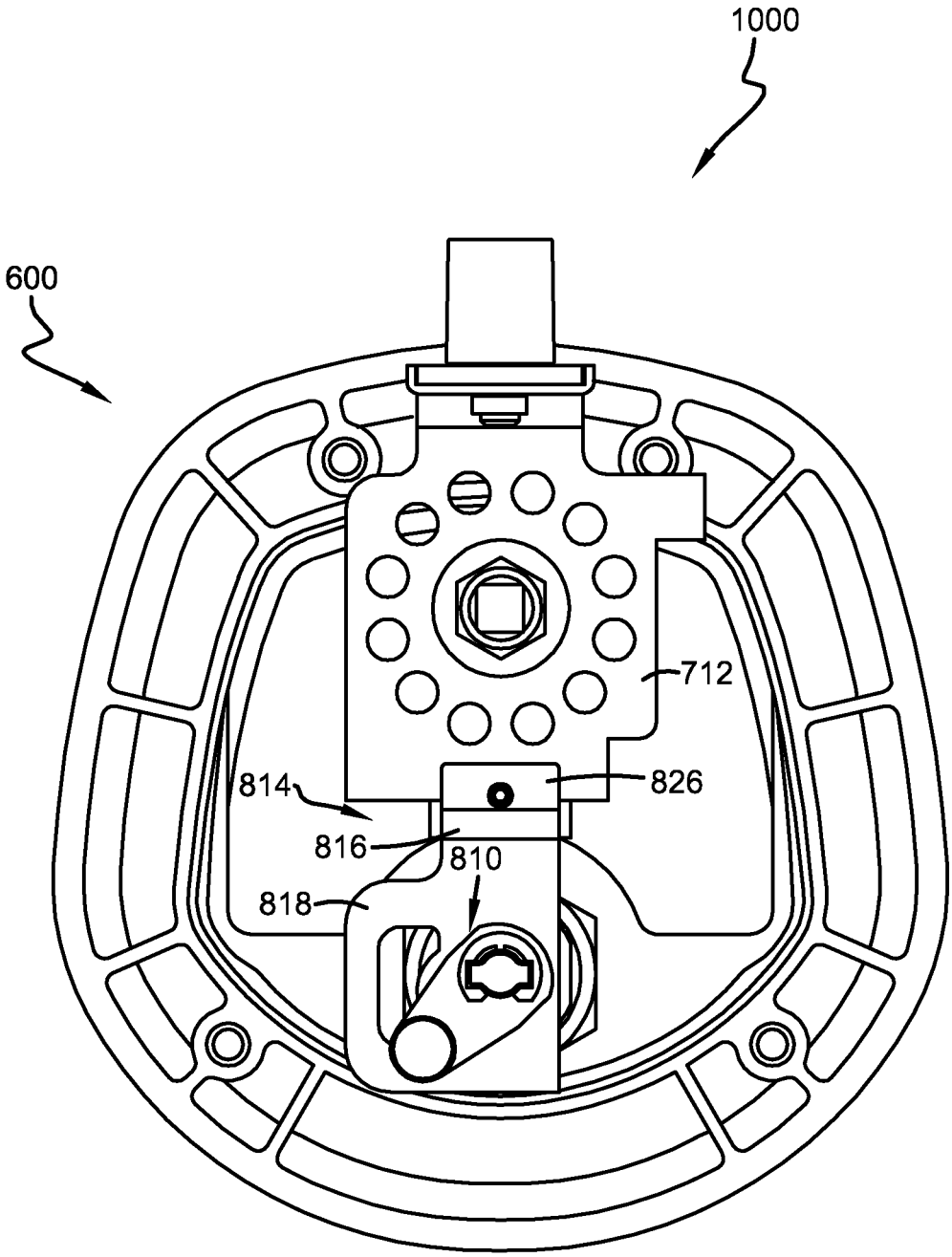
FIG. 10 is a rear view of the alternative latch assembly.

FIG. 10 shows a further rear view 1000 of the latch assembly in which the lock bolt 814 is disengaged from the control member 712. When the cam 810 moves to the position shown in FIG. 10 (as a result of the cylinder lock being placed in an unlocked configuration via a key) the cam 810 is operative to urge guide 818 such that the bolt end 816 is withdrawn from the notch 826 in the control member 712.

It is noted that several examples have been provided for purposes of explanation. These examples are not to be construed as limiting the hereto-appended claims. Additionally, it may be recognized that the examples provided herein may be permutated while still falling under the scope of the claims.

What is claimed is:

1. An apparatus comprising:

a latch assembly having a housing and a handle that is pivotable and rotatable with respect to a front side of the housing, which handle is operative to move a control member included on a rear side of the housing, wherein the latch assembly includes a lock having a rotatable portion that rotates responsive to a key, wherein the rotatable portion includes a cam having a projection that is movable responsive to rotation of the rotatable portion, wherein the latch assembly includes a lock bolt that includes a guide having at least one aperture, wherein the guide is configured such that a portion of the guide extends between and at least partially separates a first portion and a second portion of the at least one aperture, wherein the first portion of the at least one aperture of the guide includes first and second inner surfaces, wherein the projection of the cam extends in the first portion of the at least one aperture of the guide, wherein a portion of the rotatable portion of the lock extends in the second portion of the at least one aperture of the guide, wherein when the rotatable portion of the lock rotates via the key to cause the projection to move from a first position to a second position, the projection contacts the second inner surface and urges the lock bolt to engage the control member which prevents the handle from rotating, wherein when the rotatable portion rotates via the key to cause the projection to move from the second position to the first position, the projection contacts the first inner surface and urges the lock bolt to disengage from the control member, which enables the handle to rotate.

2. The apparatus according to claim 1, wherein the lock corresponds to a codable cylinder lock, wherein the codable cylinder lock includes a coding function in which the lock is capable of being coded for a key responsive to the key being inserted into the lock and rotated.

3. The apparatus according to claim 1, wherein the first inner surface is spaced apart from the second inner surface.

4. The apparatus according to claim 1, wherein the control member includes at least one of:

a latch roller; or a rod adapter.

5. The apparatus according to claim 1, wherein the handle at least one of:

includes a ring that is generally D-shaped; or is generally T-shaped.

6. The apparatus according to claim 1, wherein the latch assembly corresponds to a compression latch.

7. An apparatus comprising:

a latch assembly having a housing and a handle that is pivotable and rotatable with respect to a front side of the housing, which handle is operative to move a control member included on a rear side of the housing, wherein the latch assembly includes a lock having a rotatable portion that rotates responsive to a key, wherein the rotatable portion includes a cam having a projection that is movable responsive to rotation of the rotatable portion, wherein the latch assembly includes a lock bolt that includes a guide, wherein the guide includes two apertures therethrough, wherein a first one of the apertures includes first and second inner surfaces, wherein the projection extends in the first aperture of the guide, wherein the rotatable portion of the lock extends in a second one of the apertures of the guide wherein when the rotatable portion of the lock rotates via the key to cause the projection to move from a first position to a second position, the projection contacts the second inner surface and urges the lock bolt to engage the control member which prevents the handle from rotating, wherein when the rotatable portion rotates via the key to cause the projection to move from the second position to the first position, the projection contacts the first inner surface and urges the lock bolt to disengage from the control member, which enables the handle to rotate.

8. The apparatus according to claim 7, wherein the second aperture is elongated between a first inner end and a second inner end, wherein the second inner end is closer to the control member than the first inner end, wherein when the projection moves from the second position to the first position, the first inner end moves closer to the rotatable portion and the second inner end moves farther from the rotational portion.

9. The apparatus according to claim 8, wherein the first aperture of the guide includes an inner projection that extends between at least a portion of the first and second inner surfaces.

10. The apparatus according to claim 9, wherein the inner projection includes a radiused surface.

11. A method of operating a latch assembly, wherein the latch assembly includes a housing and a handle that is pivotable and rotatable with respect to a front side of the housing, wherein the handle is operative to move a control member included on a rear side of the housing, wherein the latch assembly includes a lock having a rotatable portion that rotates responsive to a key, wherein the rotatable portion includes a cam having a projection that is movable responsive to rotation of the rotatable portion, wherein the latch assembly includes a lock bolt that includes a guide, wherein the guide includes two apertures therethrough, wherein a first one of the apertures includes first and second inner surfaces, wherein the projection extends in the first aperture of the guide, wherein the rotatable portion of the lock extends in a second one of the apertures of the guide, wherein the first inner surface is spaced from the second inner surface, wherein when the rotatable portion rotates via the key to cause the projection to move from a first position to a second position, the projection contacts the second inner surface and urges the lock bolt to engage the control member, which prevents the handle from rotating, wherein when the rotatable portion rotates via the key to cause the projection to move from the second potion to the first position, the projection contacts the first inner surface and urges the lock bolt to disengage from the control member, which enables the handle to rotate, wherein the method comprises:

a) rotating the rotatable portion with the key placed in the lock to cause the projection to move so as to contact the second inner surface of the guide and urge the lock bolt to move, whereby the lock bolt moves into engagement with the control member.

12. The method according to claim 11, further comprising:

b) prior to (a) rotating the handle to cause the latch assembly to latch a closure member to a body member.

13. The method according to claim 12, further comprising:

c) rotating the rotatable portion with a key placed in the lock to cause the projection to move so as to contact the first inner surface of the guide and urge the lock bolt to move, whereby the lock bolt disengages from the control member, d) rotating the handle to cause the latch assembly to unlatch the closure member from the body member.

14. The method according to claim 11, wherein the lock corresponds to a codable cylinder lock, wherein the codable cylinder lock includes a coding function in which the lock is capable of being coded for a key responsive to the key being inserted into the lock and rotated, further comprising:

b) responsive to (a) carrying out the coding function through operation of the codable cylinder lock.

15. A latch assembly comprising:

a housing having a front side and a rear side;

a shaft extending through the housing along an axis from the front side to the rear side of the housing;

a handle in operative connection with the shaft on the front side of the housing;

a control member in operative connection with the shaft on the rear side of the housing, wherein the control member includes a notch, wherein the shaft is operative to move relative to the housing both axially and rotationally responsive at least in part to movement of the handle, wherein the shaft, handle, and control member are operative to rotate between a first rotational position and a second rotational position, a codable cylinder lock extending through an aperture in the housing, wherein the lock includes a lock body and a rotatable portion, wherein the rotatable portion is operative to move rotationally with respect to the lock body between a first rotatable portion position and a second rotatable portion position responsive to rotation of a key inserted into the lock mechanism, wherein the lock includes a coding function in which the lock is capable of being coded for a key responsive to the key being inserted into the lock and rotated, a cam in operative connection with the rotational portion, wherein the cam includes an arm that extends radially from the rotational portion, wherein the cam includes a projection in operative connection with a portion of the arm that is spaced apart radially from the lock body, wherein the projection extends from the arm in a direction parallel to a rotational axis of the rotational portion of the lock, wherein when the rotational portion moves between the first rotatable portion position and the second rotatable portion position, the projection moves between a first position and a second position, wherein the second position is closer to the shaft than the first position;

a lock bolt, wherein the lock bolt includes a bolt end and a guide, wherein the guide includes first and second spaced apart inner surfaces, wherein the second inner surface is closer to the shaft than the first inner surface, wherein the projection is movable to contact the second inner surface to urge the bolt end to move toward the shaft and into the notch, during movement of the projection from the first position to the second position with the control member in the first rotational position, wherein the projection is movable to contact the first inner surface to urge the bolt end to move away from the shaft and out of the notch, during movement of the projection from the second position to the first position.

16. The apparatus according to claim 15, wherein the handle includes a ring that is generally D-shaped.

17. The apparatus according to claim 15, wherein the handle is generally T-shaped.

18. An apparatus comprising:

a latch assembly, wherein the latch assembly includes a housing, wherein the latch assembly includes a control member, wherein the control member is located on a first side of the housing, wherein the latch assembly includes a handle, wherein the handle is located on a second side of the housing, wherein the handle is in operative connection with the control member, wherein the handle is prevented from rotating when the control member is prevented from rotating, wherein the handle is allowed to rotate when the control member is allowed to rotate, wherein the latch assembly includes a lock bolt, wherein the lock bolt includes a guide, wherein the guide includes two apertures therethrough, wherein a first one of the apertures includes a first contact surface and a second contact surface, wherein the first contact surface is spaced from the second contact surface, wherein the latch assembly includes a lock, wherein the lock includes a rotatable lock portion, wherein the rotatable lock portion extends in a second one of the apertures of the guide, wherein the lock portion includes a cam, wherein the cam includes a projection, wherein the projection extends in the first aperture of the guide, wherein rotation of the lock portion is operative to move the projection, wherein the projection is movable to contact the first contact surface, wherein the projection is movable while in contact with the first contact surface, to cause the lock bolt to engage the control member in a manner that prevents the control member from rotating, wherein the projection is movable to contact the second contact surface, wherein the projection is movable while in contact with the second contact surface, to cause the lock bolt to disengage from the control member in a manner that allows the control member to rotate.

19. The apparatus according to claim 18, wherein the first contact surface is opposite the second contact surface, and wherein the first inner surface is closer to the control member than the second inner surface.

* * * * *